US005875491A

United States Patent [19]

Wilkinson

[11] Patent Number: 5,875,491

[45] Date of Patent: Mar. 2, 1999

[54] ENERGY EXPENDITURE GARMENT

[76] Inventor: William T. Wilkinson, P.O. Box 73, Salem, N.J. 08079

[21] Appl. No.: 929,945

[22] Filed: Sep. 15, 1997

Related U.S. Application Data

[60] Provisional application No. 60/026,969 Sep. 20, 1996.

[51] Int. Cl.[6] ..... A41D 13/00

[52] U.S. Cl. ..... 2/69; 2/79; 2/227

[58] Field of Search ..... 2/69, 115, 108, 2/102, 79, 227, 228, 238; 482/121, 105, 124, 131; 450/74, 104

[56] References Cited

U.S. PATENT DOCUMENTS

| | | |
|---|---|---|
| 1,178,165 | 8/1916 | Lupton . |
| 2,097,376 | 10/1937 | Marshman . |
| 2,613,932 | 10/1952 | Manners . |
| 3,411,500 | 11/1968 | Gatts . |
| 3,559,654 | 2/1971 | Pope . |
| 3,759,510 | 9/1973 | Jackson . |
| 4,065,814 | 1/1978 | Fox . |
| 4,220,299 | 9/1980 | Motter . |
| 4,325,379 | 4/1982 | Ozbey . |
| 4,384,369 | 5/1983 | Prince . |
| 4,670,913 | 6/1987 | Morell . |
| 4,698,847 | 10/1987 | Yoshihara . |
| 4,910,802 | 3/1990 | Malloy . |
| 4,953,856 | 9/1990 | Fox . |
| 4,961,573 | 10/1990 | Wehrell . |
| 4,968,028 | 11/1990 | Wehrell . |
| 4,993,705 | 2/1991 | Tolle . |
| 5,033,123 | 7/1991 | Audet . |
| 5,046,194 | 9/1991 | Alaniz . |
| 5,060,315 | 10/1991 | Ewing . |
| 5,062,642 | 11/1991 | Berry . |
| 5,109,546 | 5/1992 | Dicker . |
| 5,141,223 | 8/1992 | Block . |
| 5,176,600 | 1/1993 | Wilkinson . |
| 5,186,701 | 2/1993 | Wilkinson . |
| 5,201,074 | 4/1993 | Dicker . |
| 5,203,754 | 4/1993 | Maclean . |
| 5,256,119 | 10/1993 | Tudor . |
| 5,263,916 | 11/1993 | Bobich . |
| 5,267,928 | 12/1993 | Barile . |
| 5,282,277 | 2/1994 | Onozawa . |
| 5,306,222 | 4/1994 | Wilkinson . |
| 5,308,305 | 5/1994 | Romney . |
| 5,336,139 | 8/1994 | Miller . |
| 5,357,637 | 10/1994 | Moore . |
| 5,367,708 | 11/1994 | Fujimoto . |
| 5,372,565 | 12/1994 | Burdenko . |
| 5,375,610 | 12/1994 | Lacourse . |
| 5,383,235 | 1/1995 | Peters . |
| 5,465,428 | 11/1995 | Earl . |
| 5,518,480 | 5/1996 | Frappier . |
| 5,518,481 | 5/1996 | Darkwah . |
| 5,570,472 | 11/1996 | Dicker . |
| 5,700,231 | 12/1997 | Wilkinson ..... 482/124 |
| 5,708,976 | 1/1998 | Dicker ..... 2/69 |
| 5,720,042 | 2/1998 | Wilkinson ..... 2/69 |
| 5,727,254 | 3/1998 | Dicker ..... 2/69 |
| 5,737,773 | 4/1998 | Dicker et al. ..... 2/69 |
| 5,745,917 | 5/1998 | Dicker et al. ..... 2/69 |

*Primary Examiner*—Gloria M. Hale
*Attorney, Agent, or Firm*—Connolly & Hutz

[57] ABSTRACT

An energy expenditure garment incorporates various techniques for providing resistance to the bending movements of the wearer. Such techniques include having unbalanced resistance elements and having non-elastic resistance elements such as friction pads to create a friction brake. Relatively non-elastic resistance elements could be joined together by elastic connectors.

15 Claims, 1 Drawing Sheet

ENERGY EXPENDITURE GARMENT

CROSS-REFERENCE TO RELATED APPLICATION

This application is based upon provisional application Ser. No. 60/026,969 filed Sep. 20, 1996.

BACKGROUND OF THE INVENTION

Various garments have been suggested which involve elastic elements to provide a resistance to an activity which would require the swinging or bending of the arms and/or legs and/or body. Generally, such elastic elements are elastic cords or bands which are separate from the remainder of the garment, but are otherwise attached to the garment or the elastic elements are in the form of elastic panels which are integral with the remainder of the garment. Examples of such garments described in patents are found in U.S. Pat. Nos. 5,109,546, 5,176,600, 5,186,701, 5,201,074, 5,306,222 and 5,570,472. Additional disclosures of such garments are found in various U.S. patent applications, namely, Ser. No. 08/627,426, filed Apr. 4, 1996, now U.S. Pat. No. 5,700,231 Ser. No. 08/660,098, filed Jun. 6, 1996, now U.S. Pat. No. 5,727,254, Ser. No. 08/734,736, filed Oct. 21, 1996, now U.S. Pat. No. 5,708,976, Ser. No. 08/761,290, filed Dec. 6, 1996, now U.S. Pat. No. 5,720,042, Ser. No. 08/777,453, filed Dec. 3, 1996, now U.S. Pat. 5,745,917, Ser. No. 08/802,972, filed Feb. 20, 1997, now U.S. Pat. No. 5,737,773, Ser. No. 08/802,973, filed Feb. 20, 1997, Ser. No. 08/834,887, filed Apr. 7, 1997, now U.S. Pat. No. 5,737,773, Ser. No. 08/840,917, filed Apr. 25, 1997, Ser. No. 08/880,715, filed Jun. 23, 1997, and Ser. No. 08/892,669, filed Jul. 14, 1997.

SUMMARY OF THE INVENTION

An object of this invention is to provide an energy expenditure garment which utilizes alternative techniques for providing resistance in the garment.

A further object of this invention is to provide techniques for enhancing the types of garments described in the above noted patent applications.

In accordance with one aspect of this invention an energy expenditure garment includes resistance elements in the form of panels integral with the base fabric wherein the panels are provided on the garment in a non-uniform manner in the sense, for example, that the panels on one side of the garment, such as on the right side of the front would be of a different pattern than on the other side, such as the left side of the front.

In accordance with another aspect of this invention the resistance in the garments is achieved by providing relatively non-elastic members which are joined together by friction elements or by elastic members such as springs or rubber bands.

In accordance with a further aspect of this invention the garment may be used for rehabilitation purposes wherein the garment is modified to include a stiffening member or insert between the elastic panel and the base fabric so as to support selected parts of the user's body.

THE DRAWINGS

DETAILED DESCRIPTION

The present invention relates to energy expenditure garments which could be of the types shown and described in the aforenoted patents and applications. All of the details of all of those patents and applications which are incorporated herein by reference thereto.

In accordance with one aspect of the invention an energy expenditure garment is provided which could be in the form of a one-piece or two-piece suit made from a base fabric wherein resistance elements are incorporated in the garment. In a preferred practice of the invention the resistance elements are panels which are secured to and thus integral with the base fabric. The panels may separate distinct portions of the base fabric and thus act as the structure which joins those portions of the base fabric together or the panels may overlie or underlie the base fabric. A general characteristic of the resistance elements as compared to the base fabric is that a different, preferably greater, resistance force is encountered in stretching the resistance elements and in resisting those elements from returning toward their original position than would be required for the base fabric.

Figure 1:
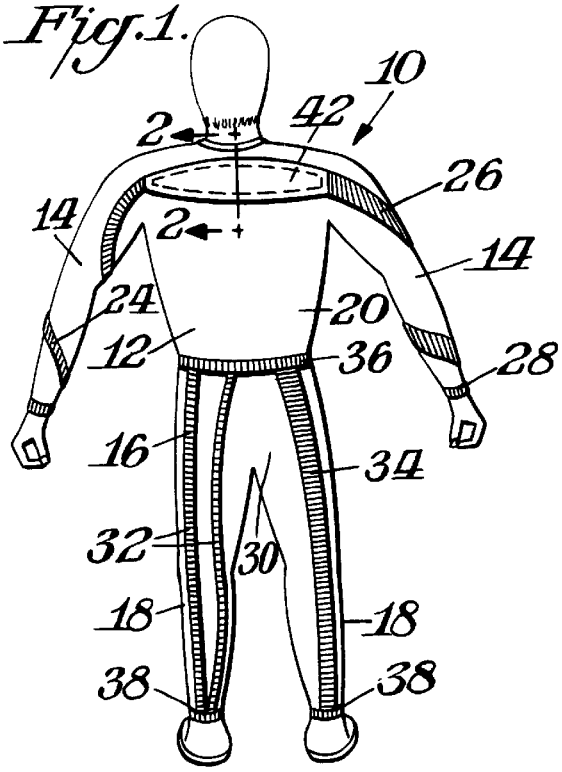
FIG. 1 is a rear elevational view showing a person wearing an energy expenditure garment in accordance with this invention.

FIG. 1 illustrates an energy expenditure garment 10 in accordance with this invention. As shown therein the garment 10 is in the form of a suit having a top or shirt 12 with elongated arms or sleeves 14. The suit also includes a pants portion 16 with elongated legs 18. Shirt or top 12 is made of a base fabric 20 and includes resistance elements 24,26 which extend up the arms and to the body portion of shirt 12. The ends of the resistance elements are anchored in any suitable manner such as by compression cuffs 28. Other forms of anchoring could be hand loops or gloves.

Pants 16 is made of a base fabric 30 and includes sets of resistance panels 32,32 on one leg and a panel 34 on the other leg. The upper ends of the various resistance panels are anchored by compression waistband or belt 36 and by ankle cuffs 38. Other forms of anchoring, such as footwear or stirrups could also be used.

Figure 2:
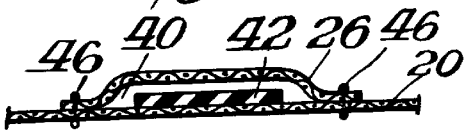
FIG. 2 is a cross-sectional view taken through FIG. 1 along the line 2—2.

FIGS. 1–2 exemplify a modification in accordance with this invention wherein the garment 10 would be particularly suitable for rehabilitation programs. In such programs it is desirable that the garment be used as a low impact way to build strength and facilitate or speed recovery. The garment could also be used as part of the treatment of injuries. As shown the base fabric 20 has the resistance panels superimposed thereover. Ordinarily, the panel would be disposed in surface to surface contact with the base fabric. As illustrated in FIGS. 1–2, however, panel 26 is formed over a portion of the base fabric in spaced relation to the base fabric so as to create a pocket 40. An insert 42 is mounted in the pocket. For purposes of illustration and clarity in understanding this invention, the pocket 40 is shown to be oversized with respect to insert 42. In practice, however, panel 26 would fit snugly around insert 42. Insert 42 is preferably made of a material imparting some degree of rigidity to a selected area of the garment so as to provide support to the user in areas which are, for example, injured or otherwise should be supported. FIG. 1 illustrates the insert 42 to be located across the shoulder area in the rear of the garment. Other inserts would be suitable at other locations in accordance with the needs of a particular user undergoing rehabilitation. Thus, the inserts 40 would be of rigid or semi-rigid form having less elastic resistance characteristics than the resistance elements which overlie the insert.

An alternative to having the insert in a pocket would be to use a stiffening insert to connect two elastic bands and locate the insert at an area of the wearer's body to be supported.

FIG. 1 illustrates a further aspect of this invention which differs from conventional structures. In this regard, conventional structures generally provide the resistance elements in a balanced manner, that is in a manner wherein there is equal force on the front and backs of the legs, arms and torso and in a symmetrical manner where the forces are equal on the right hand side as compared to the left hand side. In accordance with FIG. 1, unequal forces are provided by having resistance elements of different characteristics. Thus, FIG. 1 shows the resistance band 24 to be thinner and to be spirally arranged around its arm in a manner different than the resistance band 26 on the opposite arm. Similarly, the resistance bands 32 on one leg are of different resistance characteristics than the band 34 on the other leg. As illustrated, for example, band 34 is wider than the bands 32. A further difference is in the number of bands in that two bands 32 are provided on one leg as compared to only a single band on the other leg. The use of unequal forces is desirable to provide stronger elastic structures which oppose large muscle groups and weaker elastic structures to oppose smaller muscle groups or vise versa.

In accordance with another aspect of this invention the resistance could be provided by various relatively non-elastic techniques used alone or in combination with elastic techniques. Such non-elastic techniques could include, for example, the provision of weights on the garment or a form of friction brake such as a friction brake with cords or bands, panels, etc. Other forms of elastic techniques such as springs, bands, or rubber bands could be used in combination with elastic or non-elastic cords, panels, etc.

A particularly advantageous alternative is the use of a non-elastic friction drag mechanism. Reference is made to U.S. Pat. No. 5,460,586 all of the details of which are incorporated herein by reference thereto which describes the use of a treadmill having resistance poles mounted thereto wherein the resistance is adjustably obtained through the use of a friction brake mounted on a shaft in combination with a control knob. Such type of friction brake could be mounted on the garment at the joints such as elbows, knees, shoulders, ankles, etc. where movement of the body would be resisted by an adjustable friction brake or by spring tension, or by a piston-cylinder arrangement. All of these variations involve a resistance connection between to preferably non-elastic elements.

Figure 3:
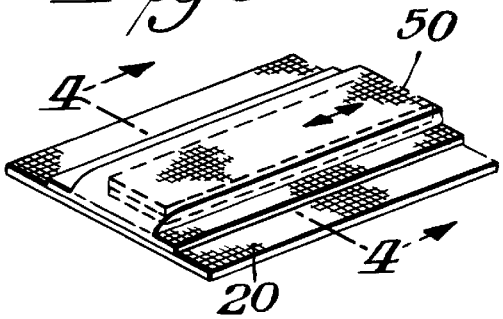
FIG. 3 is a fragmental perspective view showing a portion of an energy expenditure garment in accordance with a further aspect of this invention.
Figure 4:
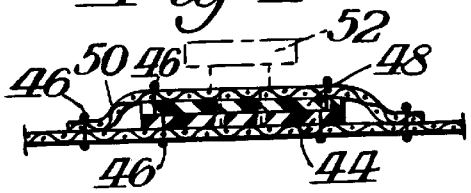
FIG. 4 is a cross-sectional view taken through FIG. 3 along the line 4—4.

FIGS. 3–4 illustrate a practice of the invention utilizing a friction brake mechanism to apply the resistance connection. As shown therein a friction pad 44 is permanently secured to base layer 20 in any suitable manner such as by fastening elements 46. Friction pad 44 would extend from a joint and then continue along a portion of the body that does not bend such as, for example, the upper arm. A second friction pad 48 is disposed over and in frictional contact with friction pad 46. Friction pad 48 may extend down the forearm and overlap friction pad 44 at the elbow. If desired, a cover 50 could be secured over the friction pads 46,48 to create a pocket for the friction pads and to confine the friction pads against lateral or outward movement so that the only movement is a relative surface to surface movement in a longitudinal direction back and forth in accordance with the bending of the elbow. Cover 50 could be secured by any suitable fastening elements 46 to base fabric 20 and upper pad 48.

If desired the amount of friction could be adjusted by incorporating a control knob 52 shown in phantom in FIG. 4 which would extend through cover 50 for engagement, for example, with a nut in cover 50 so that the threaded control knob could be selectively moved to push friction pad 48 into closer engagement with friction pad 44 or to permit the amount of friction to be lessened by moving knob 52 outwardly away from pad 44.

In use when the wearer bends the arm at the elbow, or at any other joint incorporating the friction brake, a resistance to movement would be encountered by the rubbing of one friction pad against the other so that a greater force is exerted than if no friction brake were present.

The invention could also be practiced where a garment includes one or more elastic sections mounted to one or more non-elastic sections or elastic sections with different elasticity (resiliency) characteristics. Thus, for example, an elongated cord could be provided in sections where various sections are elastic and other sections are non-elastic or of different elasticity. Preferably the sections are detachably mounted together so that the net result would be the ability to have variable elasticity by substituting different types of sections either elastic or non-elastic for other sections.

Figure 5:
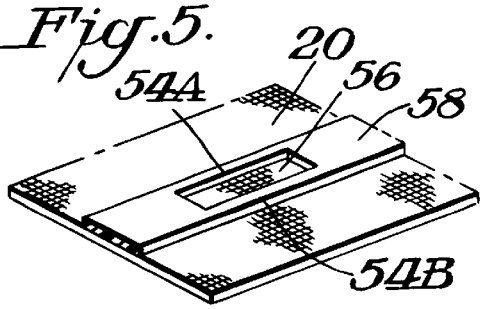
FIG. 5 is a fragmental perspective view of a portion of a garment in accordance with another aspect of this invention.

FIG. 5 illustrates a variation of the invention wherein the elastic strip or panel has a cut-out 56 thereby reducing the resistance characteristics in the portions of the panel having the cut-out since only two narrow strips 54A and 54B are located at the cut-out, in contrast to the wide continuous strip on each side of the cut-out.

Figure 6:
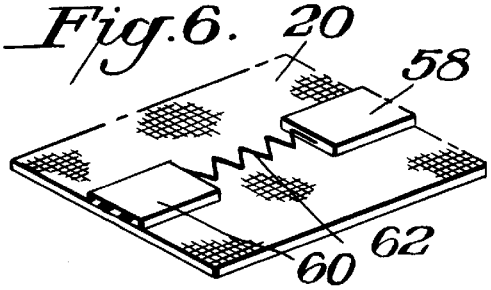

FIG. 6 shows a variation of the invention wherein a pair of elastic or non-elastic bands or panels 58,60 are interconnected by a spring 62 with the unit being mounted on base fabric 20. The resistance is thus afforded primarily by the stretching or contraction of spring 62 rather than by the elasticity of the panels 58,60. Thus, panels 58,60 could be of the same or even lesser elasticity than base fabric 20 yet the desired resistance affect would be achieved by means of spring 62.

Figure 7:
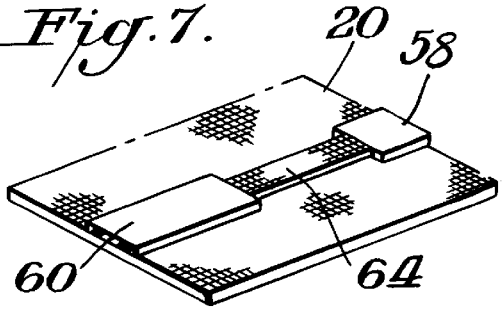
FIGS. 6–7 are views similar to FIG. 5 showing yet other variations of this invention.

FIG. 7 shows a variation of the embodiment shown in FIG. 6 wherein an elastic band, such as a rubber band 64 is used instead of a spring to interconnect the panels 58,60.

As is apparent, the various embodiments described above show different manners of enhancing the resistance characteristics of the energy expenditure garment. Further enhancement could be achieved not only in connection with the wearing of the garment but also by modifying the techniques of performing an activity. Thus, for example, during a walking movement the user might in addition to swinging the arms also twist the hands at the wrist sections inwardly or outwardly to gain added resistance.

It is to be understood that the above detailed description represents exemplary manners of practicing the invention. Various of the features shown in one embodiment can be incorporated with other embodiments within the spirit of this invention. Thus, for example, the unequal force feature illustrated in FIG. 1 could be incorporated with the specific manners of applying resistance such as in the other embodiments. It is also to be understood that the garment itself may be of any of the types of constructions described in the aforenoted patents and patent applications. Thus, the garment could be a two-piece suit such as illustrated in FIG. 1 or a one-piece suit.

What is claimed is:

1. In a energy expenditure garment comprising a suit having a body portion and a shirt portion with elongated sleeves and a pants portion with elongated legs extending outwardly therefrom, and with a plurality of elongated resistance elements mounted to a base fabric wherein the resistance elements have resistance characteristics whereby the force required for stretching said resistance elements and resisting said resistance elements from returning toward their original condition is greater than is required for said base fabric, the improvement being in that at least one of said resistance elements is in the form of a panel, and said panel having a stiffening insert with greater rigidity than said resistance panel to provide support for the user at the location of said insert.

2. The garment of claim 1 wherein said panel is mounted over said base fabric to create a pocket therebetween, and said insert being located in said pocket.

3. The garment of claim 1 wherein said panel is a first panel, said resistance elements further including a second panel, and said first panel and said second panel being connected together by said insert.

4. In an energy expenditure garment comprising a suit having a body portion and a shirt portion with elongated sleeves and a pants portion with elongated legs extending outwardly therefrom, said suit having a front side and a back side and being made from a plurality of elongated resistance elements mounted to a base fabric wherein said resistance elements have resistance characteristics whereby the force required for stretching said resistance elements and resisting said resistance elements from returning toward their original condition is greater than is required for said base fabric, and each of said sides having a right half and a left half, the improvement being in that said resistance elements on at least one of said sides of said garment have different resistance characteristics on said right half than said resistance elements on said left half to provide non-uniform resistance to said at least one of said sides of said garment.

5. The garment of claim 4 wherein said non-uniform resistance is provided by having an unequal number of resistance elements on each half of said side.

6. The garment of claim 4 wherein the non-uniform resistance is provided by having resistance elements of different physical construction on each half of said side.

7. In an energy expenditure garment comprising a suit having a body portion and a shirt portion with elongated sleeves and a pants portion with elongated legs extending outwardly therefrom, and with a plurality of elongated resistance elements mounted to a base fabric wherein said resistance elements have resistance characteristics whereby the force required for stretching said resistance elements and resisting said resistance elements from returning toward their original condition is greater than is required for said base fabric, the improvement being in that at least some of said resistance elements comprises a pair of bands joined together by a resistance connection structure which resists movement of said bands away from each other.

8. The garment of claim 7 wherein said resistance connection is a friction brake.

9. The garment of claim 8 wherein said friction brake is adjustable in the amount of friction resistance.

10. The garment of claim 7 wherein said resistance connection is a spring.

11. The garment of claim 7 wherein said resistance connection is at least one elastic element.

12. The garment of claim 7 wherein said bands are non-elastic.

13. The garment of claim 12 wherein said elongated resistance element include a first non-elastic band located at a joint on said suit and extending away from said joint, and a second non-elastic band overlapping said first non-elastic band at said joint and extending away from said first non-elastic band, and a friction pad on each of said non-elastic bands in frictional contact with each other.

14. The garment of claim 13 wherein said bands are located on said base fabric at said joint, and a cover extending over said bands at said joint to maintain said friction pads in contact with each other.

15. The garment of claim 7 wherein said band is made of an elastic material, and said resistance connection being formed by a cut-out in said band to create a pair of elastic strips on each side of said cut-out.

* * * * *